US005602530A

United States Patent [19]

Holmgren

[11] Patent Number: 5,602,530

[45] Date of Patent: Feb. 11, 1997

[54] ANTI-THEFT DEVICE FOR BOTTLES

[75] Inventor: Bertil Holmgren, Vellinge, Sweden

[73] Assignee: MW International Ltd., West Byfleet, United Kingdom

[21] Appl. No.: 525,644

[22] PCT Filed: Mar. 11, 1994

[86] PCT No.: PCT/SE94/00201

§ 371 Date: Dec. 21, 1995

§ 102(e) Date: Dec. 21, 1995

[87] PCT Pub. No.: WO94/20712

PCT Pub. Date: Sep. 15, 1994

[30] Foreign Application Priority Data

Mar. 12, 1993 [SE] Sweden ..... 9300837

[51] Int. Cl.[6] ..... G08B 13/14

[52] U.S. Cl. ..... 340/568; 340/572; 215/201; 215/207

[58] Field of Search ..... 340/572, 568; 215/202, 221, 201, 206, 207, 216

[56] References Cited

U.S. PATENT DOCUMENTS

| | | | |
|---|---|---|---|
| 445,755 | 2/1891 | King | 215/207 |
| 783,885 | 2/1905 | McDougall | 215/207 |
| 833,446 | 10/1906 | Degener | 215/207 |
| 880,723 | 3/1908 | Cumming | 215/207 |
| 1,343,962 | 6/1920 | Byrne | 215/207 |
| 1,937,295 | 11/1933 | Rettenmeyer | 215/207 |
| 2,418,039 | 3/1947 | Mays | 215/207 |
| 4,710,752 | 12/1987 | Cordery | 340/551 |
| 5,386,924 | 2/1995 | Flinta et al. | 220/284 |
| 5,464,109 | 11/1995 | Greenwald | 215/207 |
| 5,519,381 | 5/1996 | Marsh et al. | 340/572 |

FOREIGN PATENT DOCUMENTS

| | | |
|---|---|---|
| 0385540A1 | 9/1990 | European Pat. Off. . |
| 2586231 | 2/1987 | France . |
| 2608285 | 6/1988 | France . |
| 3211387A1 | 9/1983 | Germany . |

*Primary Examiner*—Jeffery Hofsass
*Assistant Examiner*—Benjamin C. Lee
*Attorney, Agent, or Firm*—Merchant, Gould, Smith, Edell, Welter & Schmidt, P.A.

[57] ABSTRACT

The invention relates to an anti-shop lifting device, intended to be passed onto and locked to a bottle-neck having an external circumferential bead. The device comprises an outer socket (15) which can be shifted in relation to an inner socket (10) between two end positions and is locked by latch means (24) in one end position. A number of retainers (21) distributed peripherally on the inner surface of the outer socket, when the outer socket is in said one end position extend into the inner socket through openings (13) in the wall of said inner socket to an engaged position in which the retainers engage behind the bead of the bottle-neck in order to prevent the anti-shop-lifting device form being withdrawn. The latch means (24) is biased to latching position but can be actuated by means of an external element (13) to a disengaged position against the bias in order to allow movement of the retainers from the engaged position and thus withdrawal of the anti-shop-lifting device from the bottle-neck.

11 Claims, 5 Drawing Sheets

ANTI-THEFT DEVICE FOR BOTTLES

Figure 1:
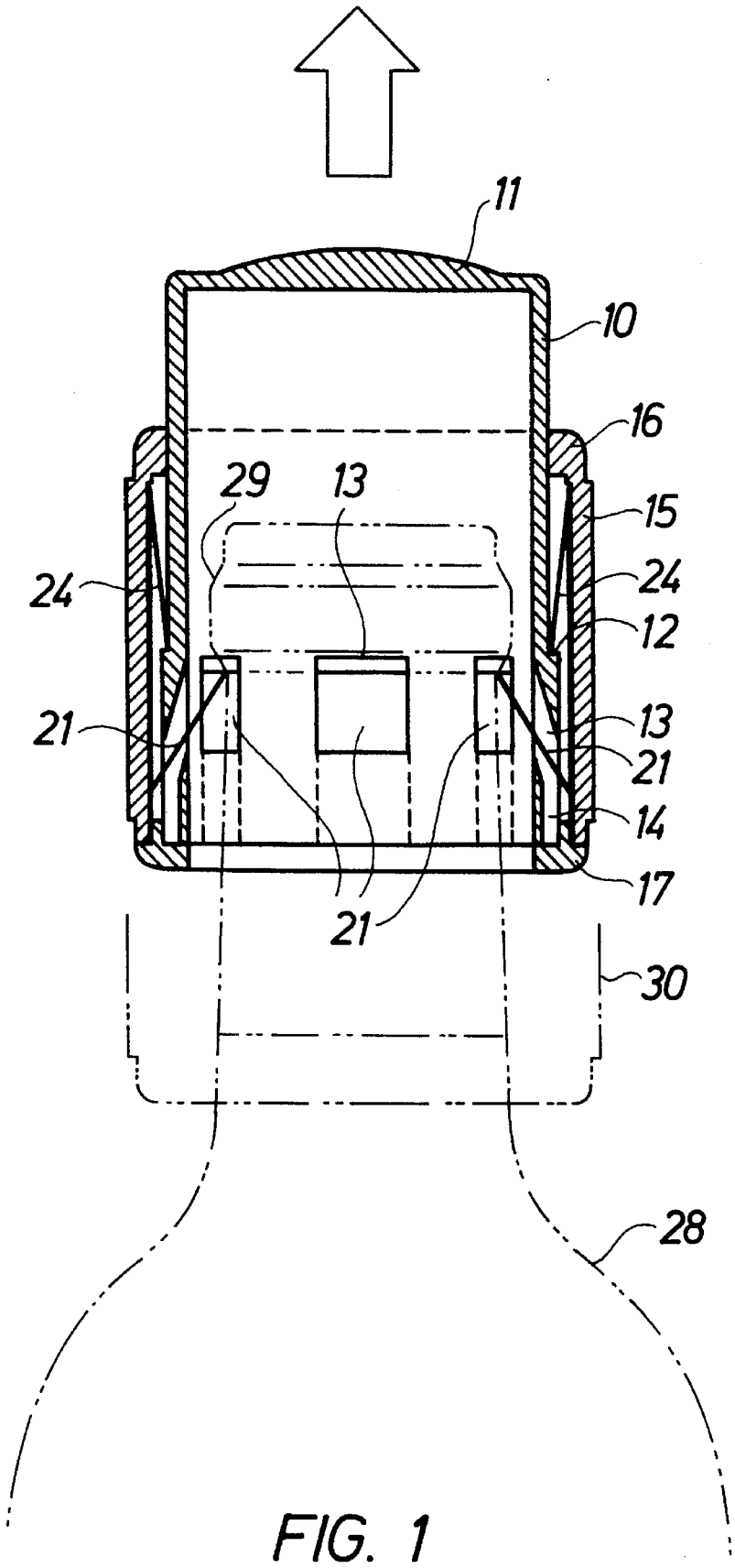

The invention relates to an anti-shop-lifting device, intended to be passed onto and locked to a bottle neck having an external circumferential bead.

By the introduction of self-service shops and super markets where the customers walk around in the premises and are able not only to look at the articles exposed but also to take them away, petty thefts and shop-lifting have increased substantially. In order that dishonest persons shall not take away goods from the shop without paying for the goods it has been necessary to introduce in the shops expensive alarm systems including an alarm element on each piece of goods, which is removed from the goods or deactivated at honest purchase when payment is made at the counter but in case this has not been done causes alarm to be given when the dishonest customer carrying the goods passes through one of the exits of the shop. Among goods inviting to shop-lifting are i.a. expensive and selected wines and liquors available in self-service shops in foreign countries, which in the future may be sold in self-service shops also in this country.

There have been presented anti-shop-lifting devices provided with an alarm element, which are intended to be locked to a bottle, and FR-A2-2 606 161 and FR-A2-2 608 285 disclose examples of anti-shop-lifting devices which are suited for application i.a. on bottles having an external circumferential bead on the bottle-neck. Then, the anti-shop-lifting device with an alarm element mounted to it is applied to the bottle by the bottle-neck being encircled by a flexible wire loop behind the bead, said loop supporting the anti-shop-lifting device on the bottle and being locked in such a way that some type of special tool is required, often a powerful magnet, for removing the wire loop and thus the anti-shop-lifting device from the bottle. This prior art anti-shop-lifting device is not particularly safe because the wire loop can easily be cut by means of common cutting nippers. Moreover, it is relatively circumstantial to apply the anti-shop-lifting device onto the bottle and to remove it therefrom.

FR-A1-2 586 231 and US-A-1 343 962 disclose devices intended to be locked to bottles in order to prevent uncorking thereof, which are not, however, provided with an alarm element.

The purpose of the invention is to provide an anti-shop-lifting device of the kind referred to above which provides practically full safety against unauthorized removal from the bottle and can be applied very easily and can be duly removed so that no additional burden need to be put on the personel at the counter, said device being well suited for the application of an alarm element on the device.

For said purpose the anti-shop-lifting device according to the invention comprises, as disclosed in FR-A1-2 586 231, an inner socket to be passed onto the bottle-neck, an outer socket mounted externally on the inner socket, which can be shifted in relation to the inner socket between two end positions, a number of retainers distributed peripherally, which in an engaged position engage behind the bead on the bottle-neck in order to prevent the anti-shop-lifting device from being withdrawn from the bottle neck, and latch means for locking the outer socket in one end position with the retainers in the engaged position, which latch means is biased to latching position but can be actuated by means of an external element to a disengaged position against the bias in order to allow movement of the retainers from the engaged position and thus withdrawal of the anti-shop-lifting device from the bottle-neck.

The anti-shop-lifting device has obtained according to the invention the characterizing features of claim 1.

Figure 2:
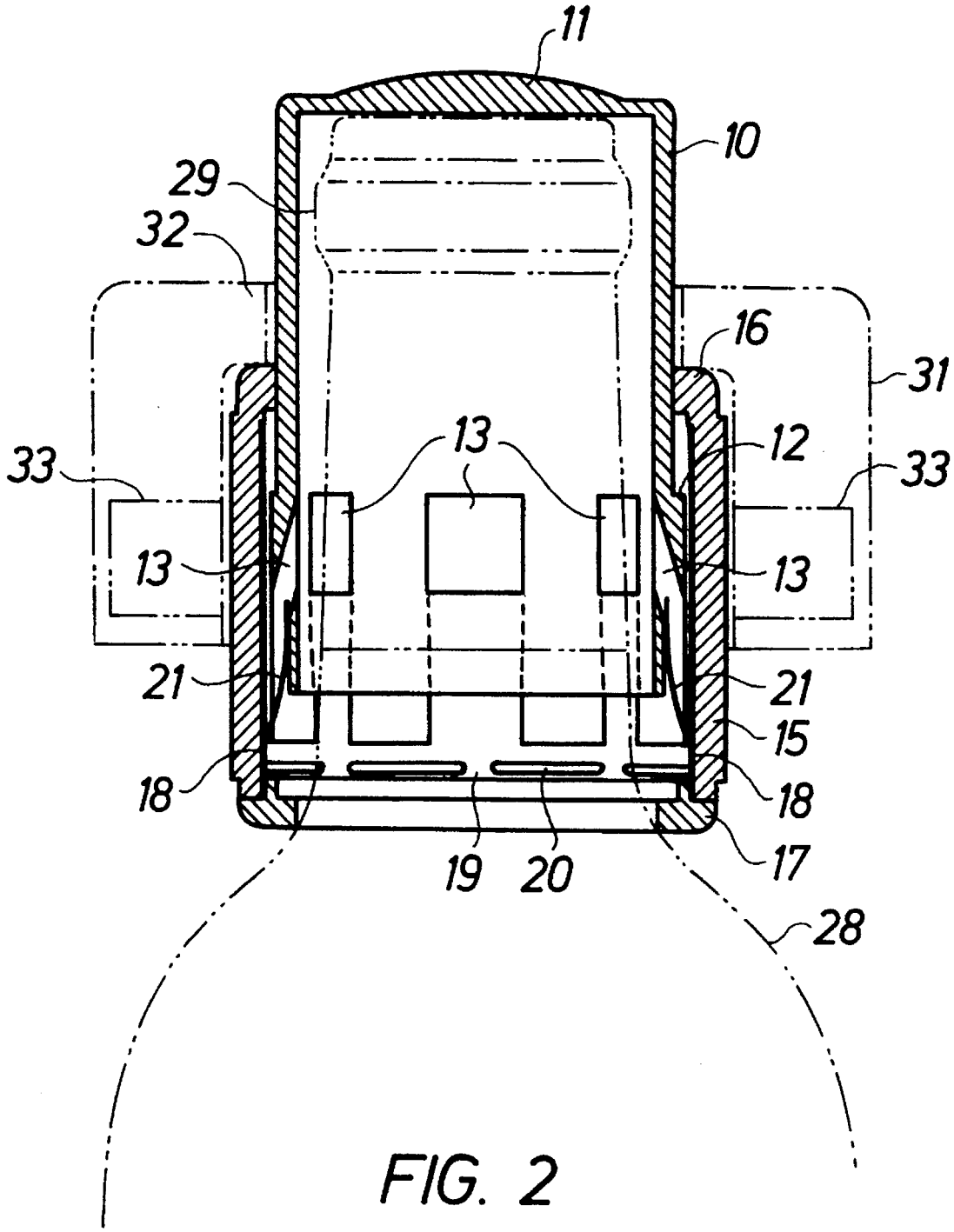
Figure 3:
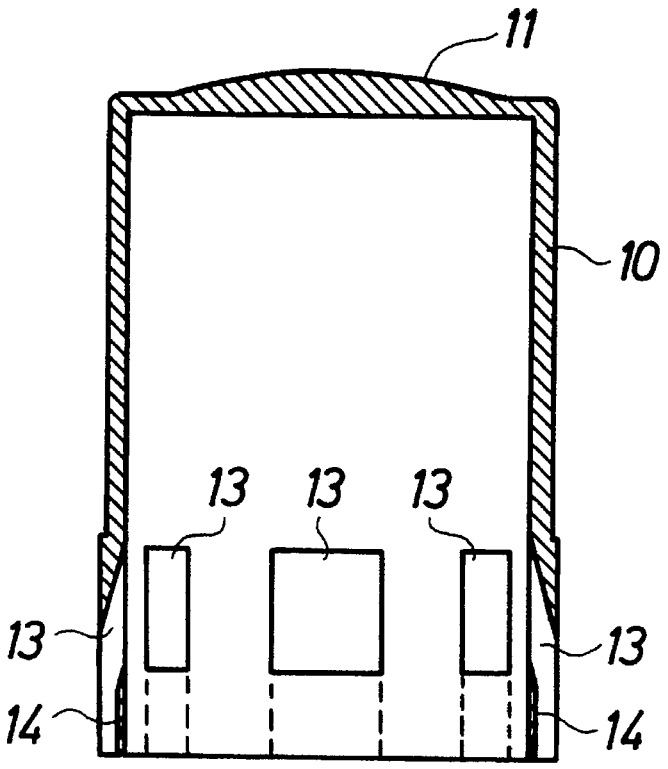
Figure 4:
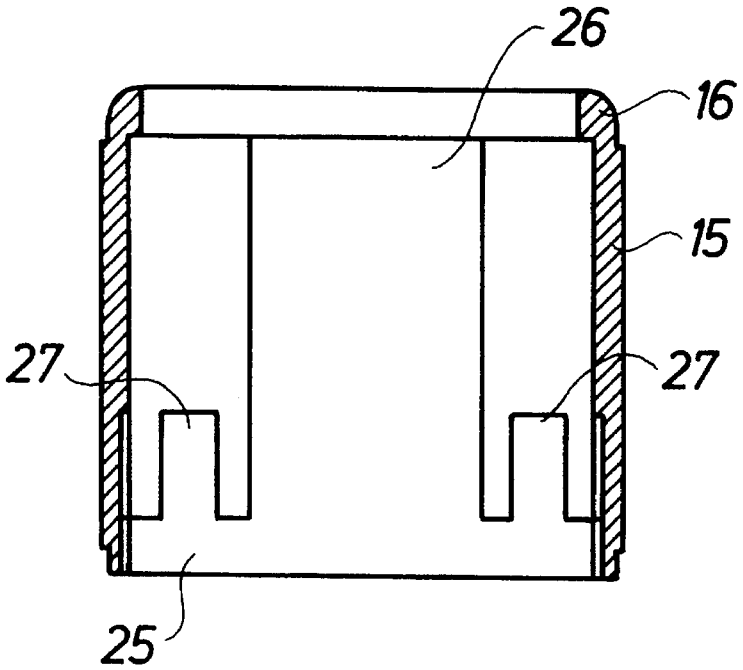
Figure 5:
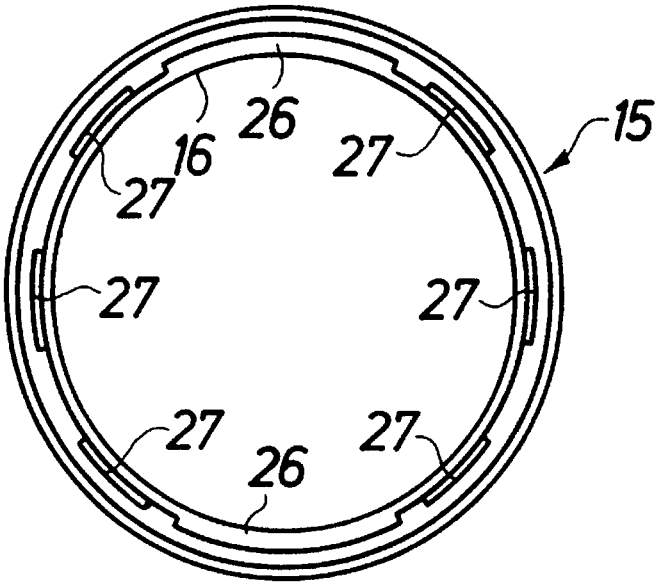
Figure 7:
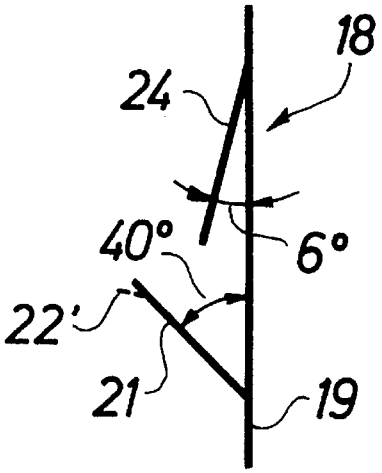
Figure 6:
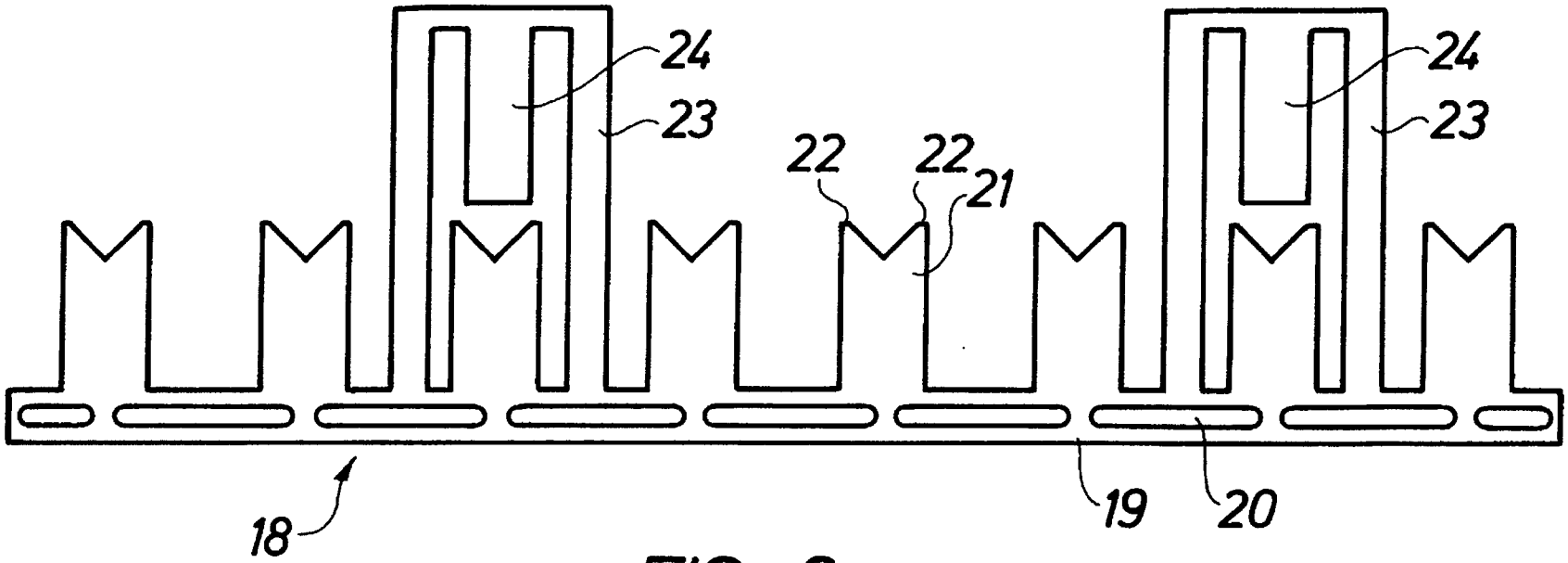

The invention will be described in more detail below reference being made to the accompanying drawings in which FIG. 1 is an axial cross-sectional view of the anti-shop-lifting device in the preferred embodiment thereof locked to a bottle indicated by dot-and-dash lines, FIG. 2 is a corresponding axial cross-sectional view of the anti-shop-lifting device in position to be withdrawn from the bottle, FIG. 3 is an axial cross-sectional view of the inner socket of the device, FIG. 4 is an axial cross-sectional view of the outer socket of the device, FIG. 5 is an end view from below of the outer socket in FIG. 4, FIG. 6 is a view of a strip of spring steel included in the anti-shop-lifting device, shown in a flattened condition said strip forming part of the latch means of the device as well as retainers of said device, provided as spring tongues, and FIG. 7 is an end view of the spring steel strip in FIG. 6.

The disclosed anti-shop-lifting device in the embodiment according to FIGS. 1–7 comprises a circular cylindrical inner socket 10 of rigid plastics, which is closed at one end thereof by an end wall 11. At the other end the socket, has a larger wall thickness than the rest of the socket a circumferential shoulder 12 being provided on the outside surface of the socket. In this thicker wall portion there are provided eight openings 13 which extend obliquely inwards towards the bottom 11 from the outside surface of the socket to the inside surface thereof. A groove 14 with flat bottom is provided at each opening 13 said groove extending from the opening to the end edge of the socket.

Externally of the inner socket 10 there is provided co-axially therewith an outer circular cylindrical socket 15 also of plastics which can be displaced axially in relation to socket 10. Socket 15 forms an annular end wall 16 at one end thereof. A ring 17 also of rigid plastics is connected to socket 15 at the other end thereof, said ring forming an annular end wall at said other end of the outer socket 15. The end walls 16 and 17 define two end positions for displacement of the outer socket 15 on the inner socket 10, viz. an end position in which the end wall 17 according to FIG. 1 engages the lower edge of socket 10, i.e. the edge at the open end of socket 10, the outer socket 15 being passed totally over the inner socket 10, and another end position wherein the end wall 16 engages shoulder 12 and which is reached by displacing the outer socket 15 from the position in FIG. 2 further downwards on the inner socket 10.

A strip 18 of magnetically attractable spring steel having a thickness of 0.3 mm and having the shape which can be seen in FIG. 6 is resiliently bent to a circular ring and mounted in the outer socket 15. The spring steel strip forms a ribbon-shaped base portion 19 having longitudinal slots 20. Eight spring tongues 21 project perpendicularly from one edge of said base portion and are uniformly distributed along the base portion, said tongues have at the free end thereof a V-shaped notch so as to form two teeth 22. The spring tongues 21 are deflected at an angle of about 40° to the base portion as will be seen from FIG. 7. Two U-shaped portions 23 are provided at the same edge of base portion 19 where the spring tongues 21 are provided. Portions 23 each connect at the limbs thereof to base portion 19 at each side of one of two spring tongues which are diametrically opposite to each other when the spring steel strip is bent to circular shape. A spring tongue 24 projects from the web of the U-shaped portion 23 towards the spring tongue 21 located between the limbs, and said spring tongue 24 is deflected in the same direction as the tongues 21 but at an angle of about 6° only as will be seen from FIG. 7.

In order to mount the spring steel strip 18 according to FIGS. 6 and 7 in the outer socket 15 there is provided in the inside surface thereof a circumferential recess 25 having two diametrically opposite rectangular enlargements 26 to receive therein the U-shaped portions 23, and six smaller rectangular enlargements 27 corresponding to spring tongues 21; two spring tongues are located at enlargements 26. The spring steel strip 18 has the ribbon-shaped base portion 19 thereof located in the circumferential recess 25 and is clamped between the inside surface of the outer socket 15 and the outside surface of ring 17 as shown in FIGS. 1 and 2, said ring covering only the lower portion of the ribbon-shaped base portion 19 so that slots 20 are uncovered. The ring 17 is connected to the outer socket 15 by ultrasound welding. The outer socket 15, the ring 17 and the spring steel strip 18 thus form a unit which can be displaced axially in relation to the inner socket 10.

When the outer socket 15 is passed completely over socket 10 as shown in FIG. 1 and the outer socket 15 thus is located in one end position thereof with end wall 17 engaging the edge surface of the inner socket 10, the free ends of spring tongues 24 are located on or immediately adjacent shoulder 12—the length of spring tongues 24 being dimensioned such that the spring tongues are positioned in this way when the outer socket 15 is in the end position thereof shown in the drawing—and thus spring tongues 24 prevent axial displacement of the outer socket 15 in relation to the inner socket 10 downwards as seen in FIG. 1, due to engagement at shoulder 12. Spring tongues 24 and shoulder 12 thus form latch means for locking the outer socket 15 in said one end position according to FIG. 1. Spring tongues 21 extend each through one of openings 13 so that the free ends thereof are located in socket 10 with spring tongues 21 directed obliquely inwards into the inner socket 10 towards bottom 11 as will be seen from FIG. 1.

When the anti-shop-lifting device having sockets 10 and 15 locked to each other in the position shown in FIG. 1 shall be applied to a bottle indicated in FIGS. 1 and 2 by dot-and-dash lines 28 and having at the mouth thereof an annular bead 29 as is customary at wine bottles and also some liquor bottles, the device is passed downwards over the bottle-neck. Then, the spring tongues 21 being resiliently pushed back to pass over bead 29 in order to resiliently engage the bottle-neck behind the bead. The anti-shop-lifting device will rest either against the bottle mouth (or the cap applied over the mouth) at the inside surface of end wall 11, or against the shoulder of the bottle depending on the shape of the bottle and the length of the bottle-neck. This rest position is partly indicated by dot-and-dash lines 30 in FIG. 1. If it is attempted to withdraw the anti-shop-lifting device from the bottle as indicated by an arrow in FIG. 1 spring tongues 21 will engage bead 29 as is also shown in FIG. 1 and thus will prevent withdrawal of the anti-shop-lifting device from the bottle. The more one pulls the device, the harder will the spring tongues engage bead 29. The spring tongues thus form retainers for retaining the anti-shop-lifting device on the bottle against unauthorized removal thereof.

In the embodiment described the anti-shop-lifting device can be used in order to prevent unauthorized uncorking of a bottle but it is preferably provided with an alarm element forming part of an alarm system which gives an alarm if a bottle having the anti-shop-lifting device applied to it should be carried out from the region protected by means of the alarm system, e.g. if a person with the protected bottle passes sensing means at the exit of a self-service shop. The alarm element which in present alarm system is rather small and flat can be mounted under a small hood or plate which is secured by ultrasonic welding to the outside surface of the outer socket 15 the alarm element by this arrangement being inaccessible and cannot be unduly removed.

Authorized removal of the anti-shop-lifting device can take place only by using a special tool which is used by the counter attendant in the self-service shop. According to FIG. 2 where the tool is indicated by dash-and-dot lines said tool consists of a ring 31 which has an inner diameter sufficiently large in order that the ring can be passed over the outer socket 15 but forms a shoulder portion 32 to engage the end wall 16 so that the ring can be placed on the socket 15. In the ring there are provided in diametrically opposite positions two powerful permanent magnets 33, and when the ring 31 with the anti-shop-lifting device in the engaged position according to FIG. 1 is passed over the outer socket 15 these permanent magnets will attract the associated spring tongues 24. If the ring is not initially opposite spring tongues 24 it is only necessary to slightly rotate the ring in order that the ring then by the magnetic attraction to the spring tongues 24 shall adjust itself to such a rotated position that the magnets will be opposite said tongues. By attraction of spring tongues 24 to magnets 33 the tongues are disengaged from the shoulder 12 so that the outer socket 15 will be released for axial displacement downwards as seen in FIG. 1 in relation to the inner socket 10. This displacement of socket 15 can be effected by pressing the ring 31 downwards. The displacement of the ring will be transmitted over shoulder portion 32 to the outer socket 15 which when moving downwards in relation to the inner socket 10 withdraws spring tongues 21 from the engaged position through openings 13 to the position shown in FIG. 2, wherein spring tongues 21 engage the bottom of grooves 14. The anti-shop-lifting can now be lifted from the bottle by ring 31 being lifted, said ring carrying with it the device in the movement thereof over the magnets 33. If the length of the bottle-neck does not allow displacement of the outer socket 15 sufficiently in order that spring tongues 21 will pass over bead 29, then it is necessary to draw the inner socket 10 upwards while the outer socket being retained by means of ring 31. This is not necessary as far as common wine bottles are concerned but it may be necessary for the many special bottles existing as far as foreign liquors are concerned.

The embodiment described having a spring steel strip which forms part of the latch means for locking the outer socket 15 to the inner socket 10, as well as the retainers required in order to prevent unauthorized removal of the anti-shop-lifting device, is the preferred embodiment because said embodiment leads to a simple and slender anti-shop-lifting device and at the same time provides great security against unauthorized removal of the anti-shop-lifting device from the bottle. Since spring tongues 21 form two teeth 22 said tongues are adapted to the cylindrical shape of the bottle-neck in order to afford the most effective engagement with the bead 29 on the bottle. The engagement can be improved further by the end portion of teeth 22 being angled towards the central axis of the sockets as indicated by a dash line at 22' in FIG. 7. The rectangular shape of spring tongues 21 is advantageous because the spring tongues will be sufficiently stiff in order to withstand braking, the tongues at the same time having a large range of movement without deformation when moving within said range. The large movement is required in order that the anti-shop-lifting device can be used for bottles with necks of different thicknesses. The described shape of the spring steel strip 18 with slots 20 and attachment of the strip with these slots exposed provides some torsion in the base portion 19 of the spring steel strip at bending of spring tongues 21. As a consequence thereof the spring tongues can be made sufficiently stiff in order to withstand removal of the anti-shop-lifting device, the tongues at the same time having a large range of movement.

In order that the cap of the bottle will not be damaged by the spring tongues 21 when the anti-shop-lifting device is lifted from the bottle it is necessary that the outer socket 15 cannot return from the position in which these spring tongues are withdrawn as shown in FIG. 2. Such return is prevented to some extent by the friction between spring tongues 21 and the bottom of groove 14. However, a snap latch for arresting the sockets for example in the position shown in FIG. 2 may be provided.

The latch means formed by the spring tongues 24 (a single spring tongue or more than two spring tongues may be provided) and the shoulder 12 can be replaced by latch means of another type for example a pin which is displaceable in the axial direction thereof and is mounted to the socket 15 in the radial direction thereof. The pin is kept engaged with a recess in the socket 10 under spring bias and can be disengaged against the spring bias by means of a magnet applied externally. It is also possible to replace spring tongues 21 by retainers of another type, for example displaceable pins which are actuated to engaged position by the outer socket 15 effecting displacement of the pins by cam action when displaced axially in relation to the inner socket 10.

In the embodiment shown the outer socket 15 is axially displaceable in relation to the inner socket 10 but it can instead be rotatable between two end positions in relation to socket 10. The outer socket can be locked in one end position by means of a spring tongue which can be attracted magnetically, or by means of a spring biased pin which can be withdrawn against the spring bias by means of the magnet. In this embodiment the spring tongues 21 may be arranged principally as a camera diaphragm.

It is not necessary that bead 29 is formed by the bottle in order that the anti-shop-lifting device can be locked against removal from the bottle. Such locking can also take place against the edge of a screw cap or the like the embodiment disclosed herein in that case being particularly suitable because the spring tongues 21 can lockingly engage also a small projection on the bottle-neck, provided by the edge of a screw cap said edge forming said bead.

I claim:

1. Anti-shop-lifting device, intended to be passed onto and locked to a bottle-neck having an external circumferential bead comprising an inner socket (10) to be passed onto the bottle-neck, an outer socket (15) mounted externally on the inner socket, which can be shifted in relation to the inner socket between two end positions, a number of retainers (21) distributed peripherally, which in an engaged position engage behind the bead on the bottle-neck in order to prevent the anti-shop-lifting device from being withdrawn from the bottle-neck, and latch means (24) for locking the outer socket in one end position with the retainers in the engaged position, which latch means is biased to latching position but can be actuated by means of an external element (31) to a disengaged position against the bias in order to allow movement of the retainers from the engaged position and thus withdrawal of the anti-shop-lifting device from the bottle-neck, characterized in that the retainers (21) distributed circumferentially on the inner surface of the outer socket, when the outer socket is in said one end position extend into the inner socket through openings (13) in the wall of said inner socket to the engaged position, the outer socket after actuation of the latch means to disengaged position being adjustable from said one end position towards the other end position under withdrawal of the retainers through the openings from said engaged position.

2. Anti-shop-lifting device according to claim 1, characterized in that the outer socket (15) can be displaced axially on the inner socket (10).

3. Anti-shop-lifting device according to claim 1, characterized in that the latch means (24) can be actuated magnetically to the disengaged position by means of the external element.

4. Anti-shop-lifting device according to claim 3, characterized in that the latch means comprises a first spring tongue (24) on the outer socket (15), which in the engaged position engages at the free end thereof a shoulder (12) of the inner socket (10) and can be adjusted to the disengaged position by magnetic attraction by means of the external element by withdrawal of the free end of the first spring tongue from the shoulder.

5. Anti-shop-lifting device according to claim 4, characterized in that two or more first spring tongues (24) are provided and that the external element (31) forms a ring which can be applied around the outer socket (15) and has magnets (33) for actuation of the first spring tongues.

6. Anti-shop-lifting device according to claim 5, characterized in that said device is provided with an alarm element forming part of an external alarm system.

7. Anti-shop-lifting device according to claim 4, characterized in that the retainers comprise second spring tongues (21) on the outer socket (15), which in the engaged position with the outer socket in said one end position extend through openings (13) in the inner socket obliquely inwards towards the mouth of the bottle to engage the bead at the free ends thereof, and by adjustment of the outer socket from said one end position towards the other end position can be withdrawn from the engaged position through said openings.

8. Anti-shop-lifting device according to claim 7, characterized in that the second spring tongues (21) are deflected towards the central axis of the sockets (10, 15) at the free end thereof.

9. Anti-shop-lifting device according to claim 7, characterized in that the second spring tongues (21) at the free end thereof have a V-shaped notch to form two pointed teeth (22).

10. Anti-shop-lifting device according to claim 7, characterized in that the first spring tongue blade (24) and the second spring tongues (21) are deflected from a spring steel strip (18) mounted to the inner surface of the outer socket (15).

11. Anti-shop-lifting device according to claim 10, characterized in that the second spring tongues (21) at the base thereof connect to one edge of a ribbon-shaped base portion (19) of the spring steel strip (18), which forms circumferentially elongated slots (20), and that the base portion is attached to the outer socket at the other edge of the base portion with said slots exposed.

* * * * *